United States Patent [19]

Baeta

[11] Patent Number: 4,948,079

[45] Date of Patent: Aug. 14, 1990

[54] SOAP DRYING STAND

[76] Inventor: Goncalves Baeta, 26 Cavell Avenue, Toronto, Ontario, Canada, M4K 1L6

[21] Appl. No.: 264,880

[22] Filed: Oct. 31, 1988

Related U.S. Application Data

[63] Continuation-in-part of Ser. No. 73,278, Jul. 14, 1987, abandoned.

[51] Int. Cl.[5] ..... A47K 5/00

[52] U.S. Cl. ..... 248/309.1; 206/77.1; 206/204; D6/540

[58] Field of Search ..... 248/309.1, 200, 205.1, 248/316.8; D6/536, 537, 538, 539, 540; 206/77.1, 204; 312/351

[56] References Cited

U.S. PATENT DOCUMENTS

| | | | |
|---|---|---|---|
| D. 32,385 | 3/1900 | Steppe . | |
| D. 149,066 | 3/1948 | Kaplan . | |
| D. 150,766 | 8/1948 | Hilenski . | |
| D. 197,503 | 2/1964 | Benton . | |
| D. 230,934 | 3/1974 | McGruden . | |
| 846,938 | 3/1907 | Nishimoto . | |
| 2,457,918 | 1/1949 | Pierce . | |
| 2,922,248 | 1/1960 | Kocsi | D6/540 X |
| 3,019,549 | 2/1962 | Evans | D6/540 X |
| 4,530,479 | 7/1985 | Chen | 248/309.1 |

FOREIGN PATENT DOCUMENTS

| | | | |
|---|---|---|---|
| 327480 | 6/1903 | France | 312/351 |
| 5695 | of 1904 | United Kingdom | D6/536 |
| 12740 | of 1906 | United Kingdom | 312/351 |
| 653755 | 5/1951 | United Kingdom | 312/351 |
| 1068605 | 5/1967 | United Kingdom | 312/351 |

*Primary Examiner*—David L. Talbott

[57] ABSTRACT

A soap drying stand comprising a first support, a soap holder/water transport structure, defining a soap holding portion for holding a bar of wet soap when placed on said stand, said soap holder/water transport structure comprising water transporting material defining a water absorbing surface at or adjacent said soap holding portion and a water evaporation surface, said material being capable of transporting water from the water absorbing surface to the water evaporation surface, and, wherein said soap holder/water transport structure is attached to said first support means, whereby said water evaporation surface is exposed to air. The invention also comprises a method of drying a wet bar of soap by placing the bar on said stand and allowing air to circulate therearound.

21 Claims, 4 Drawing Sheets

SOAP DRYING STAND

CROSS-REFERENCE TO RELATED APPLICATIONS

This application is a continuation-in-part of Ser. No. 07/073,278, filed July 14, 1987, now abandoned.

NATURE OF THE INVENTION

The invention relates to a soap drying stand and more particularly to a soap drying stand for receiving a wet bar of hand soap.

BACKGROUND OF THE INVENTION

Most sinks, showers, bath tubs and the like are provided with a soap dish, for receiving and holding a bar of soap when it is not actually being used by a person during washing. An important function of such soap dishes is to receive a wet bar of soap and to hold it while it dries. Such soap dishes may be built in or integral with the sink or bath tub fixture or adjacent counters or walls. Alternatively, the soap dishes may be separate units located conveniently nearby.

Generally, most such soap dishes define a depression in which the bar of soap rests. If a wet bar of soap is returned to the dish, water will flow or drip off the bar into the dish, resulting in a pool of water in the dish in which the soap will rest.

The presence of the water in the dish keeps the bottom of the bar of soap wet and soft and the water may dissolve some of the soap. Also, more soap may be wasted when, at next use, much of the soft soap may be quickly and ineffectively washed away. This loss of soap from the bar results in a significantly reduced useful life for the bar of soap. As a result, there may be an overall increase in use of soap, with consequent increased cost to the consumer.

When a wet bar of soap is used again the soft soap on the bottom of the bar may feel uncomfortable to the touch and appear unsightly. Furthermore, if a wet bar of soap is allowed to dry in a conventional soap dish, the drying of its once water-logged bottom may result in cracks and fissures, giving it an unattractive appearance. Furthermore, as the water in the dish dries, the soap dissolved in the water may be deposited onto the bottom and walls of the soap dish, further adding to the overall unattractive appearance of the soap dish.

Attempts have been made to ameliorate or avoid the above problems by providing drains or a drain channel in the soap dish. However, in many instances, such drains are ineffective in draining the excess water rapidly enough. In addition, they are generally ineffective in drying the film of water which lies between the bar of soap and the bottom of the soap dish.

In a further attempt to solve the above problems, formations have been added to the bottom of the soap dish in an attempt to support the bar of soap off the bottom of the soap dish. However, in many instances, such formations are ineffective because the wet bar of soap may simply sink onto the formations. After the soap has dried, the bar of soap may become stuck to the formations. In addition, when the bar of soap is used another time, the formations may leave unattractive imprints in the bar of soap. In fact, as the bar of soap sinks over the formations, it may contact the bottom of the soap dish, thus resulting in the same problems discussed above. Furthermore, even in such instances where the formations are successful in keeping the bar of soap away from the bottom of the soap dish, water may still drip off the bar into the dish. The water will evaporate leaving an unsightly residue of soap and dirt in the soap dish. If the soap dish is raised off of a counter (say, by being attached to an adjacent wall, for instance) and provided with drains, the dripping water may fall onto the counter and will eventually leave more unattractive residue.

In yet further attempts to overcome the above problems, special soap dishes have been proposed. For instance, an open mesh bag was proposed in U.S. Pat. No. 2,457,918 to allow free circulation of air of soap for improved drying. However, the disclosed soap container is ineffective in avoiding the problem of water dripping through the openings in the mesh and falling onto a surface below. In addition, the device such as that disclosed may become unsightly and the open mesh bag must be handled (i.e. turned inside out in order to eject the soap therefrom), which may be distasteful to some persons.

U.S. Pat. No. 846,936 and design patents no. D32,385, no. Des.197,503 and no. Des.149,066 also disclose open mesh dishes, which fail to solve the dripping water problem. Design patent no. Des.197,503 attempts to solve this problem by incorporating a separate drip catching plate. However, in use, the catch plate would soon become as unsightly with dried residue as other conventional soap dishes. U.S. Pat. No. 846,936, U.S. design Pat. No. Des. 149,066 and United Kingdom Pat. No. 5695 to Boult attempt to solve the drip problem by closing in the bottom portion of the soap dish to hide the unattractive area. However, such structures drastically reduce the ability of air to circulate freely around the bar of soap for effective drying action. Thus, in such soap dishes the bar of soap would stay wetter for a longer period of time, thereby promoting degeneration of the bar of soap.

STATEMENT OF THE INVENTION

The invention comprises a soap drying stand comprising a first support, a soap holder/water transport structure, defining a soap holding portion for holding a bar of wet soap when placed on said stand, said soap holder/water transport structure comprising water transporting material defining a water absorbing surface at or adjacent said soap holding portion and a water evaporation surface, said material being capable of transporting water from the water absorbing surface to the water evaporation surface, and, wherein said soap holder/water transport structure is attached to said first support means, whereby said water evaporation surface is exposed to air. The invention also comprises a method of drying a wet bar of soap by placing the bar on said stand and allowing air to circulate therearound.

The soap drying stand according to the invention reduces many of the problems of the prior art. For example, a wet bar of soap is suspended in the air whereby to allow substantially unrestricted circulation of air around the wet bar of soap and water absorbing means. The water absorbing means will catch any drips which may fall from the bar of soap and also assist in removing excess water from the bar. The water absorbing means itself may dry relatively easily and quickly by air circulation without any adverse effects on the bar of soap. In a preferred embodiment, the water absorbing means consists of a sheet of open-cell foam, which may be removed (together with a supporting mesh) occassionally from a support rim for cleaning or replacement purposes.

The various features of novelty which characterise the invention are pointed out with particularity in the claims annexed to and forming part of this disclosure For a better understanding of the invention, its operating advantages and specific objects attained by its use, reference should be had to the accompanying drawings and descriptive matter in which there are illustrated and described preferred embodiments of the invention.

IN THE DRAWINGS

DETAILED DESCRIPTION OF A SPECIFIC EMBODIMENT

Figure 1:
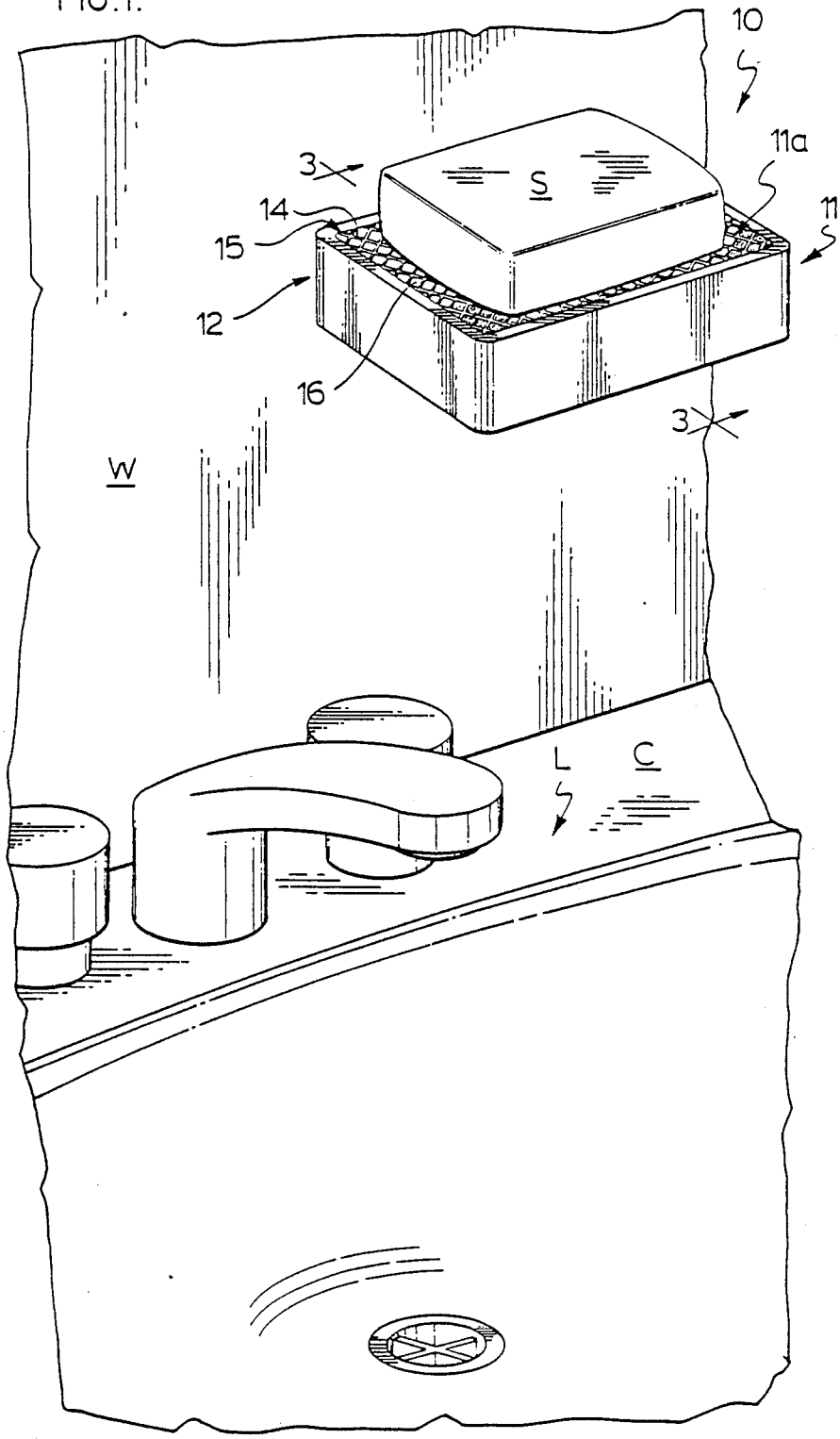
FIG. 1 is a perspective view of a soap drying stand according to the invention, shown in use.

Referring to FIG. 1, there is shown a sink facility L as may conventionally be used, for instance, in household bathrooms. Wall W is located near sink L. A soap drying stand, or dish, according to the invention, indicated generally as 10, is attached to wall W and is shown in use supporting a bar of hand soap S. In other embodiments, soap dish 10 could be attached to a separate free standing support Alternatively (although less preferable from a functional viewpoint due to the decreased possibility of air circulation) soap dish 10 could rest freely (and preferably only temporarily, until suspended in the air by attaching to a wall or free standing support) on counter top C adjacent to sink L. Such an alternative embodiment may be more convenient or handy to use, for example when temporarily used on the edge of a bathtub.

Soap dish 10 comprises a first support means, indicated generally as 11, for holding the bar of soap S. In the illustrated and preferred embodiment, first support means 11 comprises a rim formation 12.

A soap holding/water transporting means, indicated generally as 15, is attached to first support means 11. The soap holding/water transporting means 15 defines a soap holding portion 11*a*. The soap holding/water transporting means 15 absorbs water (from a wet bar of soap S) at an upper water absorbing surface and allows water to evaporate from a lower water evaporation surface.

The soap hold/water transporting means 15 comprises a second support means, i.e. mesh 14, and an adjacent water absorbing means, i.e. sheet 16. The water absorbing means 16 should be capable of absorbing water at one surface and transporting it to another surface where it may evaporate into the air.

Figure 2:
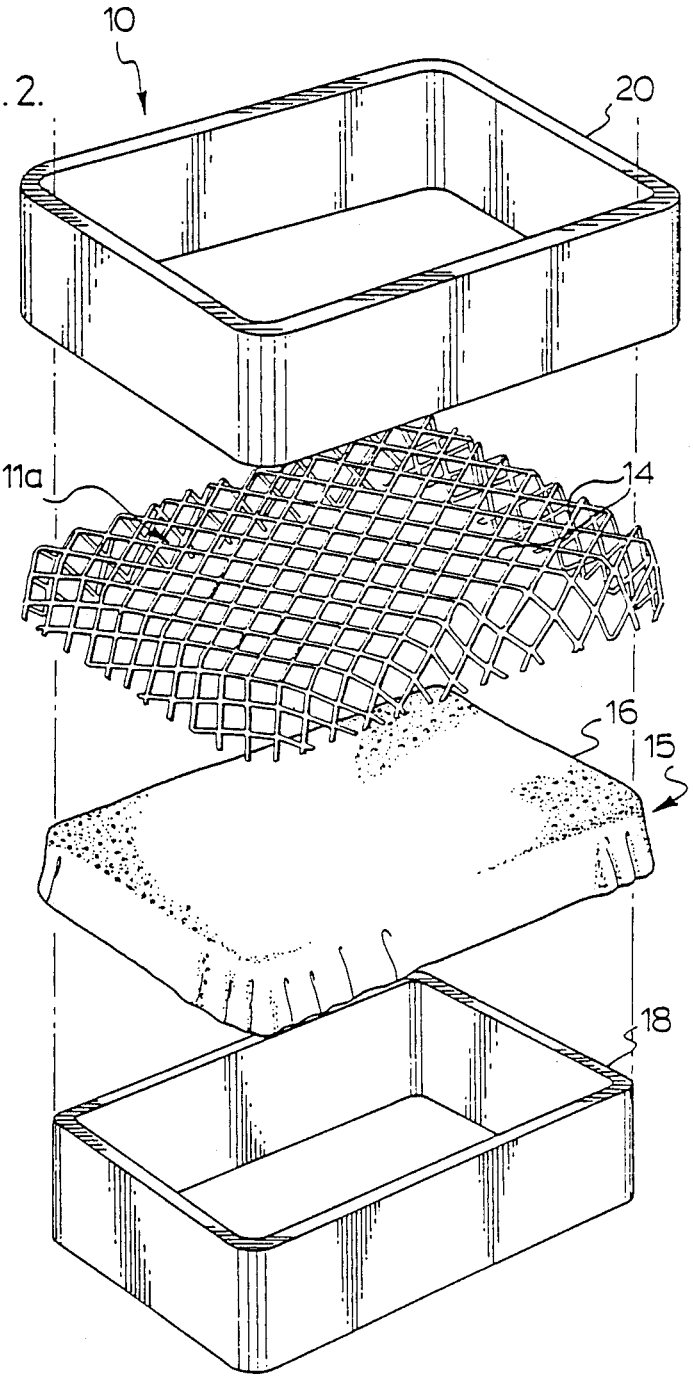
FIG. 2 is an expanded, or disassembled, view of the soap drying stand according to the invention.
Figure 3:
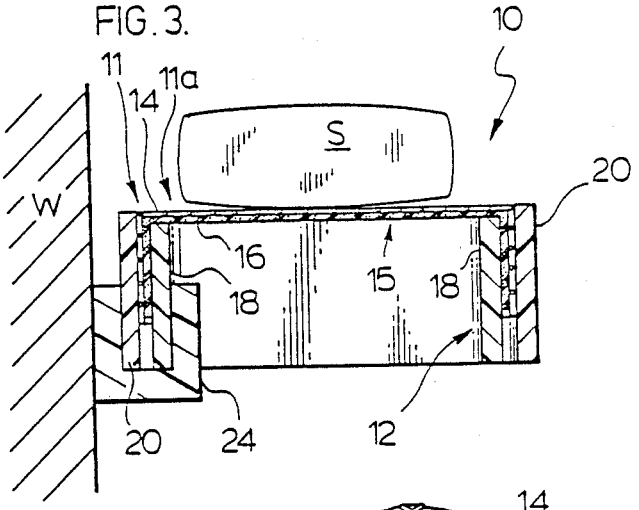
FIG. 3 is a cross-sectional view along the line 3—3 of FIG. 1.

In a preferred embodiment, as shown in FIGS. 2 and 3, rim formation 12 comprises an inner rim 18 and an outer rim 20. Inner rim 18 and outer rim 20 are shaped and sized relative to each other whereby inner rim 18 may snugly fit within outer rim 20 to snugly and securely hold mesh 14 and sheet 16 (preferably in tension) in place by friction across rim formation 12.

Figure 4:
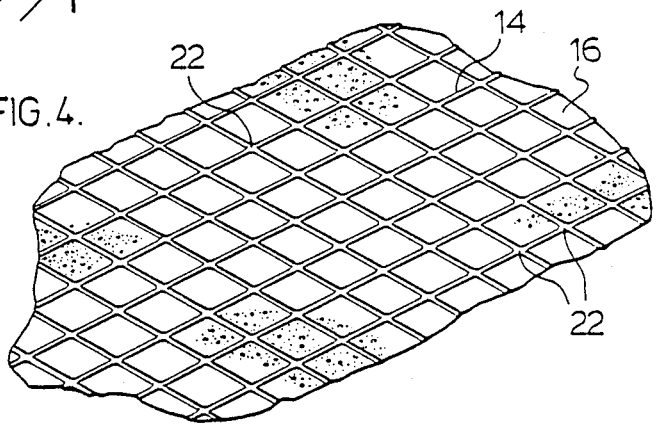
FIG. 4 is a detailed perspective view of a mesh and and sheet of water absorbing material as may be incorporated into a soap drying stand according to the invention.
Figure 5:
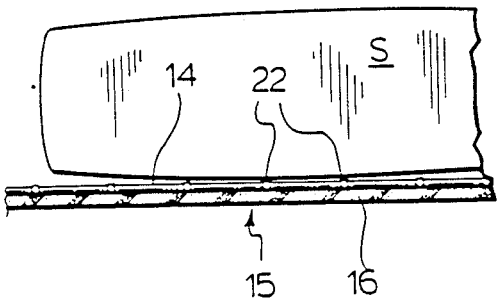
FIG. 5 is a close-up cross-sectional view of part of FIG. 3.
Figure 6:
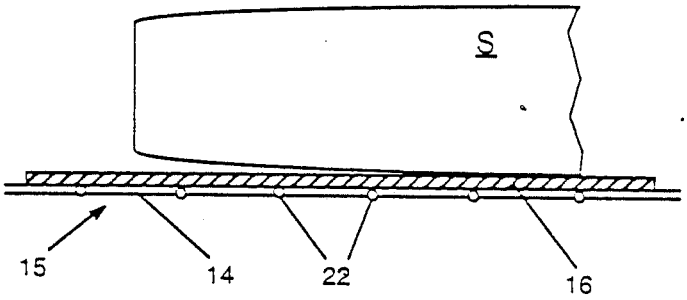
FIG. 6 is a close-up cross-sectional view corresponding to FIG. 5 of an alternate embodiment.

Referring to FIGS. 4 and 5, preferably mesh 14 defines knot formations 22 at substantially all of its various nodes (for drawing clarity in FIG. 4, such knot formations 22 are shown only schematically at the nodes specifically marked with reference numeral "22"). Preferably, for use in the illustrated embodiment, mesh 14 comprises a flexible water-proof material, such a nylon.

Sheet 16 may conveniently comprise a thin flexible sheet of open-cell foam, such as for example foam rubber.

Referring to FIG. 3, soap dish 10 may be removably mounted to a mounting surface, such as wall W, by a mounting bracket 24. The illustrated bracket 24 defines a U-shaped cross-section, one side of which is mounted to wall W by an adhesive or other fastening means (not shown). One side of rim formation 12 is placed between the two sides of bracket 24, where it may be snugly secured by friction.

In operation, a wet bar of soap S is placed on top of mesh 14, which supports much of the weight of the bar of soap S. Knot formations 22 tend to become slightly embedded in the wet soap, thereby preventing bar S from sliding around or off of soap dish 10. Knot formations 22 may absorb some water, for instance by capillary action between adjacent loops of the nylon thread forming the knot or by other means, and may expand slightly. Any water-drops, dripping off soap S, pass through mesh 14 into sheet 16. The water-drops are absorbed at one surface of sheet 16 and transported within sheet 16 to another surface thereof at which the water may evaporate into the air without interference from the bar of soap S. Air circulates around soap S, mesh 14 and sheet 16 to complete the drying. Sheet 16 dries without leaving any unsightly soap marks on the counter.

In the event that sheet 16 contacts the wet bar of soap S, water on bar S will be wicked away from the bar S by sheet 16. Preferably, however, sheet 16 will only contact the wet bar of soap S only partially or occassionally. Continuous or full contact between soap S and sheet 16 may result in sticking between sheet 16 and soap S as it dries. In addition, too much dissolved soap may be absorbed by sheet 16. As sheet 16 dries, the dissolved soap will be deposited on and inside sheet 16, thus clogging the openings therein and reducing the effectiveness and useful life of sheet 16.

As the soap S dries, knot formations 22 will also dry. As a formation 22 dries, it may shrink somewhat and may thereby decrease the possibility that the bar of soap S may become stuck to mesh 14.

Occasionally, the user may wish to clean or replace mesh 14 and sheet 16. Accordingly, inner rim 18 may be prised out or otherwise removed from its snug fit within outer rim 20, thus freeing both mesh 14 and sheet 16. Mesh 14 and sheet 16 may either be washed and replaced or a new mesh 14 or sheet 16 substituted.

The soap dish 10 may be reassembled by placing the mesh 14 and sheet 16 over inner rim 18 and snugly fitting same within outer rim 20.

In an alternate embodiment, sheet 16 may be located at top of mesh 14. In such an embodiment, the water from soap S is wicked relatively quickly away from soap S. Thus, the bar of soap S itself dries relatively quickly, while sheet 16 dries at its own rate. However, such an embodiment may suffer from the difficulties discussed above in relation to continuous or full contact between soap S and sheet 16.

In a further embodiment, the support means and water absorbing means may be made integral with each other, such as for example in a sheet of rigid, open cell foam. However, again, such an embodiment may suffer from the problem of contact with soap S.

The foregoing is a description of preferred embodiments of the invention which are given here by way of example only. The invention is not to be taken as limited to any of the specific features as described, but comprehends all such variations thereof as come within the scope of the appended claims.

I claim:

1. A soap stand for use with a bar of soap comprising means for supporting a bar of soap, said support means including a support arrangement having an open bottom and a water absorbing substrate engaged by said support arrangement to expose a water evaporation surface of said water absorbing structure to freely circulating ambient air via said open bottom, said water absorbing substrate having a water absorbing surface positioned for contact with water on a lower surface of a bar of soap placed on said support means to strip the water from the lower surface of the bar of soap, said water absorbing substrate to a side thereof opposite said water absorbing surface defining said water evaporation surface of a size sufficient to effect transfer of the stripped water to said ambient air in contact with said evaporation surface during normal use of the soap holder.

2. A soap drying stand as claimed in claim 1 wherein the water absorbing substrate comprises a relatively thin stretchable sheet of water absorbing material.

3. A soap drying stand as claimed in claim 1 wherein the water absorbing substrate comprises open-cell foam sheet material.

4. A soap drying stand as claimed in claim 3 wherein said support arrangement includes a rim formation supporting said water absorbing substrate which extends generally flatly across the rim formation and is attached thereto.

5. A soap drying stand as claimed in claim 4 wherein said support means includes a mesh located below said water absorbing substrate.

6. A soap drying stand as claimed in claim 4 wherein said support means includes a mesh located above said water absorbing substrate.

7. A soap drying stand as claimed in claim 4 including a mesh associated with said water absorbing substrate each of which is stretched across the rim formation.

8. A soap drying stand as claimed in claim 7 wherein said rim formation comprises an outer rim and an inner rim sized and shaped whereby to fit within said outer rim and said mesh and said sheet material pass over said inner rim and said rims, mesh and sheet are securely held in place relative to each other by friction.

9. A soap drying stand as claimed in claim 8 wherein said sheet material is below the mesh.

10. The soap drying stand as claimed in claim 9 wherein said mesh defines knot formations at its various nodes.

11. A soap drying stand as claimed in claim 4 wherein said mesh and said sheet material are removably attached to said rim formation.

12. A soap drying stand as claimed in claim 1 further comprising a mounting bracket attached to said support means and adaptable to be secured to a mounting surface.

13. A soap drying stand as claimed in claim 12 wherein said bracket is integral with said support means and adaptable to be secured to a mounting surface.

14. A soap drying stand as claimed in claim 13 further comprising a mounting bracket attached to said support means and adaptable to be secured to a mounting surface.

15. A soap drying stand as claimed in claim 14 wherein said mounting bracket defines a generally U-shaped cross section and said rim formation is sized to be removably snugly secured therein.

16. A soap drying stand comprising:

first support means having an open bottom;

soap holder/water transport means, defining a soap holding portion for holding a bar of wet soap when placed on said stand, comprising water transporting material defining a water absorbing surface at or adjacent said soap holding portion and a freely exposed water evaporation surface opposite said water absorbing surface and of a size equal to or greater than said water absorbing surface and exposed within the open bottom of said first support means, said material being capable of transporting water from the water absorbing surface to the water evaporation surface; and wherein said soap holder/water transport means is attached to said first support means, whereby said water evaporation surface is exposed to freely circulating ambient air via said open bottom of said first support means.

17. A soap drying stand as claimed in claim 16 wherein said soap holder/water transport means further comprises second support means attached to said first support means and said water transporting material comprises a relatively thin sheet of open-cell foam, adjacent said second support means whereby said sheet is substantially horizontal, one surface of said sheet defining said water absorbing surface and the other surface of said sheet defining said water evaporation surface.

18. A method of drying a wet bar of soap comprising:

placing said wet bar on a soap drying stand comprising first support means having an open bottom, a soap holder/water transport means, defining a soap holding portion for holding a bar of wet soap when placed on said stand, said soap holder/water transport means comprising a water transporting material defining a water absorbing surface at or adjacent said soap holding portion and a water evaporation surface located opposite said water absorbing surface and exposed in said open bottom of said first support means, said material being capable of transporting water from the water absorbing surface to the water evaporation surface, which soap holder/water transport means is attached to said first support means, whereby said water evaporation surface is exposed to freely circulating ambient air via said open bottom of said first support means; and allowing air to circulate around said soap drying stand.

19. A method as claimed in claim 18 wherein said soap holder/water transport means further comprises second support means attached to said first support means and said water transporting material comprises a relatively thin sheet of foam, adjacent to said second support means whereby said sheet is substantially horizontal, one surface of said sheet defining said water absorbing surface and the other surface of said sheet defining said water evaporation surface.

20. In a soap drying stand for use in association with a bar of soap, the improvement comprising a sponge like water absorbing material in contact with the lower surface of the bar of soap supported by said stand, said sponge like water absorbing material effecting transfer of absorbed water to the surface thereof opposite the soap, said opposite surface being of a size and in contact with a body of air to effect evaporation of the transferred water to the body of air, said sponge like water absorbing material being supported by an open bottom support arrangement, the open bottom of said support arrangement allowing essentially unrestricted air circulation with said opposite surface of said water absorbing material.

21. A method of removing water from a lower surface of a wet bar of soap comprising:

contacting the lower surface of the bar of soap with a first surface of a water absorbing substrate to strip the water from the lower surface as it is absorbed by the water absorbing substrate, transferring the absorbed water to an evaporation surface located opposite the first surface under the influence of gravity, supporting said water absorbing substrate in a support arrangement having an open bottom, and exposing the evaporation surface to freely circulating ambient air via said open bottom to effect transfer of the absorbed water to the circulating ambient air by means of evaporation.

* * * * *